US006183524B1

(12) United States Patent
Ahmed

(10) Patent No.: US 6,183,524 B1
(45) **Date of Patent: *Feb. 6, 2001**

(54) POLYMERIC FUEL ADDITIVE AND METHOD OF MAKING THE SAME, AND FUEL CONTAINING THE ADDITIVE

(75) Inventor: Irshad Ahmed, Plainsboro, NJ (US)

(73) Assignee: Pure Energy Corporation, New York, NY (US)

( * ) Notice: Under 35 U.S.C. 154(b), the term of this patent shall be extended for 0 days.

This patent is subject to a terminal disclaimer.

(21) Appl. No.: 09/546,495

(22) Filed: Apr. 11, 2000

Related U.S. Application Data

(63) Continuation of application No. 08/953,809, filed on Oct. 20, 1992, now Pat. No. 6,074,445.

(51) Int. Cl.[7] ..... C10L 1/18; C10L 1/22
(52) U.S. Cl. ..... 44/385; 44/386; 44/418
(58) Field of Search ..... 44/385, 386, 418

(56) References Cited

U.S. PATENT DOCUMENTS

| | | | |
|---|---|---|---|
| Re. 35,237 | 5/1996 | Gunnerman | 123/1 A |
| 3,615,295 | 10/1971 | Manary, Jr. | 44/78 |
| 3,752,383 | 8/1973 | Allen et al. | 228/37 |
| 3,876,391 | 4/1975 | McCoy et al. | 44/51 |
| 4,083,698 | 4/1978 | Wenzel et al. | 44/51 |
| 4,085,126 | 4/1978 | McConnell et al. | 260/404 |
| 4,105,418 | 8/1978 | Mohnhaupt | 44/78 |
| 4,110,283 | 8/1978 | Capelle | 260/23 AR |
| 4,204,481 | 5/1980 | Malec | 123/1 A |
| 4,295,859 | 10/1981 | Boehmke | 44/51 |
| 4,330,304 | 5/1982 | Gorman | 44/63 |
| 4,375,360 | 3/1983 | Washecheck et al. | 44/53 |
| 4,451,265 | 5/1984 | Schwab | 44/51 |
| 4,477,258 | 10/1984 | Lepain | 44/51 |
| 4,609,376 | 9/1986 | Craig et al. | 44/53 |
| 4,744,796 | 5/1988 | Hazbun et al. | 44/51 |
| 5,156,114 | 10/1992 | Gunnerman | 123/1 A |
| 5,320,761 | 6/1994 | Hoult et al. | 252/9 |
| 5,393,791 | 2/1995 | Roberts | 514/762 |
| 5,394,740 | 3/1995 | Schramm et al. | 73/64.48 |
| 5,445,179 | 8/1995 | Di Lullo et al. | 137/13 |
| 5,746,785 | 5/1998 | Moulton et al. | 44/443 |
| 6,074,445 * | 6/2000 | Ahmed | 44/385 |

FOREIGN PATENT DOCUMENTS

| | | |
|---|---|---|
| 0 002 004 A1 | 5/1979 | (EP) . |
| 0 157 684 A1 | 10/1985 | (EP) . |
| 0 431 357 A1 | 6/1991 | (EP) . |
| 2 403 381 | 4/1979 | (FR) . |
| 738749 | 10/1955 | (GB) . |
| 1438974 | 6/1976 | (GB) . |
| 2 217 229 | 10/1988 | (GB) . |
| 2 217 229 | 7/1992 | (GB) . |
| 9621753 | 10/1996 | (GB) . |
| 2 308 129 | 6/1997 | (GB) . |
| 7-145390 | 6/1995 | (JP) . |
| 8157893 | 6/1996 | (JP) . |
| 1773933 A1 | 7/1992 | (SU) . |
| WO 91 07579 | 5/1991 | (WO) . |
| WO 92 07922 | 5/1992 | (WO) . |
| WO 92 14807 | 9/1992 | (WO) . |
| WO 98 17745 | 4/1998 | (WO) . |

OTHER PUBLICATIONS

Michael Ash and Irene Ash, "Handbook of Industrial Surfactants," Gower Publishing Company, England (1993), pp. v, 196, 366, 367, 495, 496, 673, 700, 721, and 763.
NEODOL®: Product Guide for alcohols, ethoxylates, and derivatives, Shell Chemical Company (Jul. 1994).
International Search Report in PCT/US98/22124 dated Feb. 22, 1999.
Written Opinion in PCT/US98/22124 dated Aug. 4, 1999.

* cited by examiner

*Primary Examiner*—Margaret Medley
(74) *Attorney, Agent, or Firm*—Marshall, O'Toole, Gerstein, Murray & Borun

(57) ABSTRACT

A polymeric fuel additive, a method of making the additive, and a fuel containing the additive are disclosed. The additive is prepared by isothermally mixing an ethoxylated alcohol and an amide, wherein the ethoxylated alcohol comprises at least about 75 weight percent of at least one linear, straight-chain alcohol having a hydrocarbon chain length of about nine to about fifteen carbon atoms, and wherein the amide is formed by reacting an alcohol amine with an equimolar amount of an alkyl ester of a fatty acid or derivative. The alcohol/amide product is isothermally mixed with a substantially equimolar amount of an ethoxylated fatty acid having a hydrocarbon chain length of about nine to about fifteen carbon atoms to produce the polymeric additive. The inventive method is carried out with gentle mixing so as to avoid molecular degradation of the additive.

34 Claims, No Drawings

POLYMERIC FUEL ADDITIVE AND METHOD OF MAKING THE SAME, AND FUEL CONTAINING THE ADDITIVE

CROSS REFERENCE TO RELATED APPLICATION

This is a continuation of U.S. patent application Ser. No. 08/953,809 filed Oct. 20, 1997, now U.S. Pat. No. 6,074,445 issued Jun. 13, 2000.

BACKGROUND OF THE INVENTION

1. Field of the Invention

The invention relates to a fuel additive. More specifically, the invention relates to a polymer useful as a fuel additive, and a method of making and using the same.

2. Brief Description of Related Technology

Numerous fuel additives are available for gasoline and diesel fuels. Currently, different fuel additives are required to enhance different properties of a given fuel and/or to address environmental concerns such as emissions reduction, fuel efficiency, water contamination, and engine degradation. With the advent of oxygenated fuels, alternative fuels, and engineered fuels, different fuel additives must be developed to account for the various characteristics inherent in these new fuels. However, there is no one single fuel additive currently designed to address multiple performance and regulatory issues simultaneously in a cost effective manner.

Conventional fuel additives for use with gasoline and diesel fuels are designed to behave as a detergent, a surfactant, or a lubricating agent. Because of their design, such fuel additives have a limited range of application. Furthermore, larger quantities and a large variety of additives are necessary to enhance multiple properties of a given fuel.

Conventional additives using surfactants or detergents are directed to enhancing emulsification or dispersion characteristics of a fuel. Although the use of surface active agents in conventional gasoline and diesel fuel is useful when, for example, it is necessary or desirable to improve the interaction between polar and non-polar media such as between oil and water or oil and a solid, the use of surface active agents in an oxygenated fuel, an alternative fuel and an engineered fuel has been limited due to instability problems inherent in combining surface active agents with such fuels. Furthermore, the use of fuel additives in such fuel systems has been limited due to economic constraints and due to lack of regulatory and/or commercial incentives.

Exposure to moisture and water during production, transportation, distribution, and storage results in water contamination of hydrocarbon fuels. The presence of three percent or more water in the fuel storage system and at the pump is common. The water is not miscible with hydrocarbon and is only slightly soluble in alcohol. The presence of water as a separate layer and its entry into the fuel injection system of an internal combustion engine results in erratic performance and emission characteristics. Furthermore, exposure of water into the fuel delivery system and combustion chambers has been shown to result in corrosion of the entire fuel-utilization system reducing its operational life and/or performance. It would be desirable to have an additive that would solubilize any water or moisture present in the fuel into a homogeneous solution with consistent combustion characteristics.

In the distribution system of conventional gasoline and diesel, the water remains in the bottom of the storage tank due to density differences between the hydrocarbon fuel components and the water. Even when shipped through pipelines, any water or moisture present in the gasoline or diesel fuels separates out as a separate layer upon storage in settling tanks. However, with the advent of alternative, oxygenated, reformulated, and engineered fuels, a slight presence of water results in a phase separation of the fuel into two permanent layers severely restricting its distribution, storage, and use characteristics.

It would be desirable to provide a fuel additive that is capable of enhancing multiple performance characteristics of a given fuel. It would be desirable to have an additive that would solubilize any water or moisture present in the fuel into a homogeneous solution with consistent combustion characteristics. It would also be desirable to provide an additive capable of improving the combustion efficiency and emissions reduction characteristics of a fuel. Furthermore, it would be desirable to provide a method of making such a fuel additive based on the fuel composition to be enhanced.

SUMMARY OF THE INVENTION

It is an object of the invention to overcome one or more of the problems described above.

According to the invention, a homogeneous polymeric fuel additive and a method of forming and using the additive are provided. The method includes forming a mixture of an ethoxylated alcohol and an amide. The ethoxylated alcohol comprises a high concentration of at least one or more linear straight-chain alcohol having a hydrocarbon chain length of at least about nine carbon atoms. The amide is formed by reacting an alcohol amine with an alkyl ester of a fatty acid. The method further includes mixing the ethoxylated alcohol/amide mixture with an ethoxylated fatty acid or derivative having a hydrocarbon chain length of at least about nine carbon atoms to form the polymeric fuel additive.

The invention also provides a fuel additive made by the inventive method, a fuel comprising an effective amount of the additive.

Other objects and advantages of the invention will be apparent to those skilled in the art from a review of the following detailed description, taken in conjunction with the appended claims.

DETAILED DESCRIPTION OF THE INVENTION

The invention provides a fuel additive and methods of making and using the same. The additive includes an ethoxylated alcohol comprising at least about 75 weight percent of at least one linear, straight-chain alcohol having a hydrocarbon chain length of about nine to about fifteen carbon atoms, and a substantially equimolar (with respect to the alcohol) amount of an amide formed by reacting an alcohol amine with an equimolar amount of an alkyl ester of a fatty acid, preferably at a reaction temperature of about 100° C. to about 110° C. Still further, the additive includes an equimolar amount of an ethoxylated fatty acid formed by reacting an unmodified fatty acid with ethylene oxide. Preferably, the additive includes equimolar amounts of each of the ethoxylated alcohol, amide, and ethoxylated fatty acid.

The inventive additive is made by a method including the step of forming a reaction product of substantially equimolar amounts of the ethoxylated alcohol and the amide, preferably at a temperature of about 55° C. to about 58° C., and subsequently isothermally reacting the resulting product with an equimolar amount of the ethoxylated fatty acid. In the polymer additive production process, the ethoxylated alcohol and fatty acid act as monomers while the amide serves as the chain initiator. Each of the alcohol, amide, and fatty acid may be dissolved in a solvent for purposes of facilitating the industrial-scale manufacture of the inventive fuel additive.

A method of using the inventive fuel additive includes admixing the additive (preferably in a low concentration) with a fuel. Thus, the invention is also directed to a fuel composition that includes a hydrocarbon-based fuel comprising one or more constituents having hydrocarbon chain lengths of about four to about thirty carbon atoms and the inventive fuel additive. The volumetric ratio of the inventive fuel additive to the fuel may be very low (e.g., about 1:1000) to achieve desired performance characteristics.

The fatty acids may be used both as a primary component of the final additive composition as well as in the preparation of an amide by combining an ethanolamine (mono-, di-, or tri-) with a desired fatty acid or derivative.

The unmodified fatty acid and the alcohol are ethoxylated using a known ethoxylating agent, such as ethylene oxide, prior to forming the additive. The overall degree of ethoxylation of the additive is preferably maximized to achieve maximum water solubilization without detrimentally affecting the performance characteristics of the fuel. Increasing the degree of ethoxylation results in a phase change of the ethoxylated higher alcohols and fatty acids from a liquid to a solid limiting its application to the fuel. The disadvantage of having a lower degree of ethoxylation is that higher quantities of the additive is required to achieve a desired result. Higher concentrations of the additive in a given application are limited both by cost and legal regulations. Any substance added in quantities above 0.25 percent must be reported with its full life-cycle evaluation under environmental regulations which would further limit the commercial viability of the fuel additive.

Commercially available sources of alcohols utilize both straight-chain and branched-chain synthetic alcohols (i.e., isomers) and/or naturally-occurring alcohols such as oleic, lauric, palmitic, stearic, and other alcohols of higher fatty acids. Commercially available alcohols, such as Synperonic 91/2.5 and Synperonic A3, which are manufactured by ICI Chemicals, and Dobanol 91/2.5, which is manufactured by Shell Chemical, contain large quantities of isomers. For example, the Synperonic class of alcohols contain as much as 50 weight percent branched isomers. Presence of branched isomers in the inventive fuel additive is undesirable because branched isomers limit the degree of ethoxylation that can be achieved before the onset of a phase change from a liquid to a solid. Conventional additive formulations use alcohols containing large amounts of branched isomers.

The Neodol class of alcohols, such as the Neodol 91/2.5 and Neodol 1/3 products, have low concentrations of branched isomers, and typically have a linear, straight-chain alcohol concentration of about 75 weight percent to about 85 weight percent and an average molecular weight of 160. (The Neodol class of alcohols are ethoxylated to 2.5 or 3.0 degrees of ethoxylation per mole of alcohol as represented by the "91/2.5" and "1/3," respectively.) For applications in heavy fuels such as diesel and kerosene, similar quantities of higher ethoxylated alcohols are preferred, such as Neodol 1/6 and Neodol 1/8. Most other commercially available alcohols have molecular weights exceeding 200. It has been determined, however, that lower molecular weight alcohols will permit a higher degree of ethoxylation without the onset of a phase change from a liquid to a solid. Thus, the ethoxylated alcohol preferably should have a molecular weight of less than about 200, and highly preferably less than about 160. Attempts to achieve a higher degree of ethoxylation with a higher molecular weight alcohol would result in the onset of a phase change at lower concentrations of the ethoxylating agent then with a lower molecular weight alcohol.

The inventive additive is prepared using ethoxylated alcohols having as low a concentration of branched-chain molecules as possible. The ethoxylated alcohol used in the preparation of the inventive additive should also have as large a chain length as possible without increasing the viscosity so much that a phase change occurs, the onset of which is typically indicated by increased surface tension. Increased surface tension of higher alcohols results in the solidification of the additive and suppresses the blending and performance characteristics of the fuel.

Conventional amides for use in prior fuel additives are prepared by reacting a fatty acid with an alcohol amine in a 2:1 molar ratio at a temperature between 160° C. and 180° C. Such amides are contaminated with free amines, which are not conducive to ethoxylation. It has been discovered that a superamide works better then conventional amides (such as, ethanolamide, diethanolamide, and triethanolamide) in the preparation of the inventive fuel additive. Superamides for use in the inventive fuel additive are preferably prepared by heating an alkyl ester of a fatty acid with an equimolar amount of an alcohol amine (e.g., ethanolamine) at temperature of about 100° C. to about 110° C. Superamides contain little to no free amines.

An unmodified higher fatty acid or derivative having a hydrocarbon chain length of at least about nine carbon atoms may be ethoxylated using ethylene oxide in a molar ratio of 7:1 (seven degrees of ethoxylate per mole of fatty acid). Unmodified fatty acid ethoxylation produces a 90–95 percent ethoxylated fatty acid. However, conventional ethoxylated fatty acids used in the preparation of prior fuel additives used a polyglycol ether of a higher fatty acid and not an unmodified higher fatty acid. Ethoxylation of a polyglycol ether of a higher fatty acid results in a poorly ethoxylated end-product. Furthermore, the commercially available ethoxylated fatty acids based on polyglycol ether show significantly lower end-product yields due to the presence of free polyethylene glycol. A lower degree of ethoxylation of the fatty acid results in an inferior effect of the additive and hence larger quantities to achieve same result.

The ethoxylated alcohol and the amide are blended together under conditions such that the formed blend does not experience phase inversion from a liquid solution to a solid. It has been determined that isothermally blending, as by mixing, the alcohol and amide at a temperature of about 55° C. to about 58° with gentle mixing results in a solution, which does not solidify, and that the solution viscosity does not significantly change when the solution is cooled to a temperature below about 55° C. to about 58°. Heretofore, it has not been possible to create such a blend that was not also temperature sensitive. An ethoxylated fatty acid is subsequently contacted, as by mixing, with the blend at a constant temperature of about 55° C. to about 58° C. to result in the inventive fuel additive.

The particular hydrocarbon chain length of each of the ethoxylated alcohol, the ethoxylated fatty acid, and the alkyl ester of a fatty acid are preferably selected according to the compositional make-up of the fuel. As known in the art, the composition of a fuel may be determined with reference to its distillation curve (which is a plot of vaporization temperature v. amount vaporized). Each particular vaporization temperature range and the amount vaporized within the temperature range corresponds to a different hydrocarbon material mix representing a fixed range of carbon chain lengths and its concentration. Furthermore, the time it takes to reach a particular vaporization temperature corresponds to the concentration of the particular hydrocarbon material in the fuel. For example, a vaporization temperature range of about 210° C. to about 223° C. at atmospheric pressure represents hydrocarbon chain lengths of $C_{12}$ to $C_{13}$ in a regular gasoline fuel. The amount evaporated within this temperature range would represent the concentration of the $C_{12}$ to $C_{13}$ hydrocarbons present in the gasoline fuel. Thus, by determining the amount vaporized at a particular vaporization temperature range, one is able to determine the particular concentration of a particular hydrocarbon material in a fuel.

Generally, it is believed that the selected hydrocarbon chain length of the ethoxylated alcohol and the ethoxylated fatty acid should be similar to the average chain length of the hydrocarbon compounds comprising the fuel. It is also believed that an even higher-performance additive may be produced by forming an individual additive corresponding to each hydrocarbon constituent of the fuel, and subsequently blending the formed additives to form one additive mixture based on the relative concentration of the hydrocarbon constituents in the fuel. The greater the variety of hydrocarbon constituents, the more desirable it would be to make a blend of additives corresponding to selected hydrocarbon constituents of the fuel. For a diesel fuel, for example, which is known to contain approximately twenty hydrocarbon constituents having chain lengths from about eight to about 30 carbon atoms, it would be advantageous to make an additive for a number of these constituents and then blend the additives into one mixture based on the relative concentration of each constituent. For engineered fuels, which contain as few as only three hydrocarbon constituents, a blend of additives may not be necessary.

The amount of the formed additive for use with a particular fuel depends upon the performance enhancements desired. As stated above, the additive according to the invention is capable of enhancing multiple performance characteristics of a fuel. However, it is also capable of enhancing certain performance characteristics more so than others depending on the amount of the additive blended with a fuel. For example, a formed additive may be admixed with a diesel fuel to improve sulfur emissions, or to solubilize high water content, or to increase gas millage. Depending on the particular fuel composition, if the additive:fuel ratio is 1:100, the sulfur emissions might be greatly reduced; if the additive:fuel ratio is 2:100, the gas mileage may dramatically increase; if the fuel contains up to five weight percent water, for example, an additive:water ratio in the fuel of 5:100 would effectively solubilize the water without detrimentally affecting other performance characteristics of the fuel. Due to the various characteristics of a fuel, and the number of fuels, it is difficult to provide a singular relationship for all fuels with respect to each performance characteristic. A calibration curve may be used to determine the application dosage for the enhancement of a desired property. The calibration curve is generated by varying the additive dosage into a fuel and determining the effect of the additive on selected properties. For example, if one is interested in determining the minimum concentration of the additive necessary for a 60 percent reduction in a particular emission component from a standard fuel with a fixed distillation curve representing a carbon-chain fingerprint, emissions of the particular component (y) is measured in a step-wise increment of the additive (x). The x-y plot generated is then used to determine the additive dosage for all fuels with similar distillation curves to achieve the desired reduction in emissions.

As noted above, the inventive fuel additive may be mixed with a known fuel in a additive:fuel volumetric ratio of as low as about 1:1000. Furthermore, the inventive fuel additive may be mixed with a known fuel in a additive:fuel volumetric ratio of as high as about 1:100 to achieve any desired improvements in performance and emission characteristics. To solubilize water into a hydrocarbon fuel without alcohols, a linear relationship has been determined such that the additive:water (to be solubilized) ratio is about 0.1:1. For oxygenated and/or alcohol-containing fuels, the quantities of the additive necessary is further reduced depending upon the water solubility capacity of the alcohol present.

Addition of the inventive fuel additive to a hydrocarbon fuel in very small quantities has shown a measurable reduction in interfacial surface tension of the fuel via both redistributing the overall electrochemical charges of the fuel and the hydrogen-bonding effect. This in turn allows a more complete burn of the fuel at the point of combustion due to reduction in droplet size resulting in a significant increase in fuel surface area in contact with air. A more complete burn results in a significant reduction in emissions, such as carbon monoxide, nitrous oxides, particulate matter, and unburned hydrocarbons.

The multiple functionality of the inventive fuel additive is based in part on a polymeric chain constructed using nonionic surface active agents. Although similar surface active agents have been used as primary ingredients in the manufacture of conventional fuel additives, such additives did not form polymeric chains. Fuel additives in the form of a polymeric chain enable solubilization of water into any hydrocarbon-based fuel to result in a micellular relationship between multiple fuel additive molecules. Thus, instead of utilizing conventional, temperature-sensitive, reversible emulsification techniques to effectively disperse water within a fuel, the inventive fuel additive employs a solubilization technique which has proven to be much more stable and less sensitive to temperature variations. Furthermore, it has been found that the solubilization mechanism is able to hold water in colloidal-type suspension permanently. Accordingly, it is now possible to efficiently burn fuels having a high water content in conventional engines. The possibility of burning fuels having high water content with the use of the inventive fuel additive would eliminate the need for expensive unit operations necessary to remove water and other known fuel contaminants.

The ability of prior art additives comprising surfactants such as higher fatty acids (e.g., polyglycol ether of a fatty acid) and alcohols to solubilize water is limited due to the degree of ethoxylation available on the surfactants. The higher the degree of ethoxylation available on the additive the greater its ability to solubilize water. One significant limitation to increasing the degree of ethoxylation of a higher fatty acid or an alcohol in the prior art is the onset of a phase change from a liquid to a solid. The change to a solid phase effectively limits application of such a fuel additive. The inventive fuel additive, on the other hand, is able to achieve higher degrees of ethoxylation without the onset of a phase change. This is accomplished by utilizing linear, straight-chain alcohols. It is, therefore, preferred that the ethoxylated alcohol used in making the additive be comprised of a high concentration of linear, straight-chain molecules and little to no branched-chain isomers.

The inventive fuel additive may be used with a fuel composition, as described in U.S. patent application Ser. No. 08/644,907 filed May 10, 1996, now U.S. Pat. No. 5,697,987 issued Dec. 16, 1997, comprising: (a) ten to 50 percent by volume of a hydrocarbon component comprising one or more hydrocarbons having about five to about eight carbon atom straight-chained or branched alkanes essentially free of olefins, aromatics, benzene and sulfur; (b) 25 to 55 percent by volume of a fuel grade alcohol; and (c) 15 to 55 percent by volume of a co-solvent for the hydrocarbon component and the fuel grade alcohol. The fuel composition may optionally contain up to 15 percent by volume of n-butane.

The co-solvent for the hydrocarbon component and the fuel grade alcohol in the aforementioned fuel composition is preferably derived from waste cellulosic biomass materials such as corn husks , corn cobs, straw, oat/rice hulls, sugar cane stocks, low-grade waste paper, paper mill waste sludge, wood wastes, and the like. Co-solvents capable of being derived from waste cellulosic matter include methyltetrahydrofuran (MTHF) and other heterocyclical ethers such as pyrans and oxepans. MTHF is particularly preferred because it can be produced in high yield at low cost with bulk availability, and possesses the requisite miscibility with hydrocarbons and alcohols, boiling point, flash point and density.

More preferred motor fuel compositions contain from about 25 to about 40 percent by volume of pentanes plus, from about 25 to about 40 percent by volume of ethanol, from about 20 to about 30 percent by volume of MTHF and from zero to about ten percent by volume of n-butane.

EXAMPLES

The following examples are provided to further illustrate the invention but are not intended to limit he scope thereof. All parts and percentages are by volume unless otherwise indicated.

Example 1

In order to solubilize up to five percent water in a gasoline fuel containing $C_8$ through $C_{18}$ hydrocarbon chain lengths (as determined by a distillation curve), the initial boiling point (IBP), and the volume fractions evaporated at ten degree intervals were examined to determine the distribution of carbon chain lengths in the fuel. An IBP of 95.1° F. (35.1° C.) and an end point of 387.7° F. (197.6° C.) were determined.

A close examination of the volumetric evaporation vs. evaporation temperature showed that quantities evaporated between each 10° F. interval were almost the same indicating that a singular (and not a mixture of) additive is sufficient to solubilize water into the fuel. Also, based on the range of the carbon chain-length present ($C_8$ through $C_{18}$), the following composition of the additive is determined to construct the polymer.

| Additive Component | Carbon Chain Lengths Present | Degree of Ethoxylation | Component Ratio | Remarks |
|---|---|---|---|---|
| Higher Alcohol | $C_9 + C_{10} + C_{11}$ | 2.75 | 46% | 1:1 Ratio of Neodol 91/2.5 and Neodol 1/3 |
| Superamide | $C_{13}$ | — | 26% | Diethanolamide of a fatty acid methyl ester |
| Fatty Acid | $C_{11}$ | 7 | 28% | Seven moles of ethoxylate per mole of fatty acid |

A higher alcohol was initially blended at a temperature of about 55° C. to about 58° C. with the superamide in a 7:4 volumetric ratio by slowly stirring until a homogeneous solution was obtained. To this mixture, an ethoxylated fatty acid is isothermally added in a 5:2 volumetric ratio by slowly stirring until a clear homogeneous solution is obtained.

The polymeric additive was slowly admixed in volumetric increments of 0.1% based on the volume of the fuel being treated. The temperature of the mixture while the additive was being blended preferably was above the cloud point of the fuel at all times during blending. When about 0.5% of the additive had been added, a sample was taken to determine the amount of free water in the gasoline using Karl Fischer method. If free water was found to be present in the fuel, volumetric increments of 0.1% of the additive were added until all of the free water was solubilized.

The treated fuel was then tested for stability by studying the effect of temperature on solubilized water between −21° C. and +40° C. using gas chromatography and/or HPLC technique. It two different phases were observed at any time during this treatment, separate samples from each layer were extracted to determine a partition coefficient.

A final end-point of 1.2% additive was obtained to solubilize 5% water in the gasoline fuel.

Example 2

In order to solubilize up to five percent water in a diesel fuel containing $C_{15}$ through $C_{30}$ hydrocarbon chain lengths as determined by a distillation curve, the initial boiling point (IBP), and the volume fractions evaporated at ten degree intervals were examined to determine the distribution of carbon chain lengths in the fuel. An IBP of 145° F. (62.8° C.) and an end point of 488° F. (253.3° C.) were determined.

A close examination of the volumetric evaporation vs. evaporation temperature showed that quantities evaporated between each 10° F. interval were almost the same indicating that a singular (and not a mixture of) additive is sufficient to solubilize water into the fuel. Also, based on the range of the carbon chain-length present ($C_{15}$ through $C_{30}$), the following composition of the additive was determined to construct the polymer.

| Additive Component | Carbon Chain Lengths Present | Degree of Ethoxylation | Component Ratio | Remarks |
|---|---|---|---|---|
| Higher Alcohol | $C_9 + C_{10} + C_{11}$ | 3.83 | 60% | 1:1 Ratio of Neodol 91/2.5, Neodol 1/3, and Neodol 1/6 |
| Superamide | $C_{13}$ | — | 20% | Triethanolamide of a fatty acid methyl ester |
| Fatty Acid | $C_{11}$–$C_{14}$ | 6 | 20% | Six moles of ethoxylate per mole of fatty acid |

A higher alcohol was initially blended at a temperature between 55–58° C. with the superamide in a 3:1 volumetric ratio by slowly stirring until a homogeneous solution was obtained. To this mixture, a mixture of $C_{11}$–$C_{14}$ ethoxylated fatty acid isothermally was added in a 4:1 volumetric ratio by slowly stirring until a clear solution was obtained.

The polymeric additive was admixed in volumetric increments of 0.1% based on the volume of the fuel. The temperature of the mixture while the additive was being blended preferably was above the cloud point of the fuel at all times during blending. When about 0.5% of the additive had been added, a sample was taken to determine the amount of free water in the diesel fuel using Karl Fischer method. If free water was found to be present in the fuel, volumetric increments of 0.1% of the additive were added until all of the free water was solubilized.

The treated fuel was then tested for stability by studying the effect of temperature on solubilized water between −21° C. and +40° C. using gas chromatography and/or HPLC technique. If two different phases were observed at any time during this treatment, separate samples from each layer were extracted to determine a partition coefficient.

A final end-point of 1.5% additive was obtained to solubilize 5% water by volume in the diesel fuel.

Example 3

In order to solubilize up to five percent water in an engineered fuel made up of ethanol, $C_5$ through $C_8$ hydrocarbons, and methyltetrahydrofuran (MTHF) with hydrocarbon chain lengths between $C_2$ and $C_8$, distillation curve was not necessary to determine an appropriate additive composition. The overall water solubility in the fuel was theoretically determined based on the solubility of water in ethanol and MTHF co-solvent. For example, if the composition of the fuel mixture could solubilize three percent water by volume without an additive, the use of an additive may only be required to solubilize the remaining two percent water by volume.

Since the requirement for the additive was less stringent, and the fuel resembled the lower-end gasoline carbon in chain lengths with an added co-solvent due to ethanol and MTHF, the diethanolamide in the blend was replaced with a monoethanolamide and both the degree of ethoxylation and carbon chain lengths of the components were reduced for economic reasons.

| Additive Component | Carbon Chain Lengths Present | Degree of Ethoxylation | Component Ratio | Remarks |
|---|---|---|---|---|
| Higher Alcohol | $C_9 + C_{10} + C_{11}$ | 2.67 | 50% | 2:1 Ratio of Neodol 91/2.5 and Neodol 1/3 is employed |
| Superamide | $C_9$ | — | 30% | Monoethanolamide of a fatty acid methyl ester |
| Fatty Acid | $C_{11}$ | 3 | 20% | Three moles of ethoxylate per mole of fatty acid |

A higher alcohol was initially blended at a temperature of about 55° C. to about 58° C. with monoethanolamide in a 5:3 volumetric ratio by slowly stirring until a homogeneous solution was obtained. To this mixture a $C_{11}$ ethoxylated fatty acid was isothermally added in a 4:1 volumetric ratio by slowly stirring until a clear solution was obtained.

The polymeric additive was admixed in volumetric increments of 0.1% based on the volume of the fuel. The temperature of the mixture while the additive was being blended preferably was above the cloud point of the fuel at all times during blending. When about 0.4% of the additive had been added, a sample was taken to determine the amount of free water in the engineered fuel using Karl Fischer method. If free water was found to be present in the fuel, volumetric increments of 0.1% of the additive were added until all of the free water was solubilized.

The treated fuel was then tested for stability by studying the effect of temperature on solubilized water between −21° C. and +40° C. using gas chromatography and/or HPLC technique. If two different phases were observed at any time during this treatment, separate samples from each layer were extracted to determine a partition coefficient.

A final end-point of 1.1% additive was obtained to solubilize 5% water by volume in the fuel.

Example 4

An improvement in the emissions profile of gasoline is desired. The blend presented for the additive in Example 1 was used to determine the combustion characteristics of gasoline. First a calibration curve was obtained using a reference fuel UTG-96. This was accomplished by preparing samples of gasoline-additive blends in various proportions with 0.050% increments. The blended fuel was placed in a test vehicle and, using FTP testing protocol combustion, gases were captured to determine an emission spectrum of various gases. At least eight data points were collected based on incremental blend compositions and a curve was drawn correlating emission levels with additive concentration.

The subject fuel was blended with a sufficient quantity of the additive as determined by the calibration curve. After completing stability tests, samples were taken and burned in the test vehicle using same protocol used in calibration. If the desired reduction was achieved, no more additive was necessary. However, if the calibration curve had underestimated the additive necessary for the desired emission reduction, the additive in the increment of 0.05% was added until the desired effect was obtained.

Example 5

It was desired to stabilize a biodiesel fuel based on a complex mixture of soy methyl ester, ethanol, kerosene, and gamma-valerolactone components. The presence of an ester required that the fuel should not be exposed to water contamination. Although no water solubility is necessary, protection from future water contamination was desired. Furthermore, a homogenization of the various fuel components was necessary due to a large carbon chain-length spread.

Since the composition of this fuel resembled the diesel fuel discussed in Example 2 above, a substantially similar additive composition as presented in Example 2 could be used with certain modifications. A closer examination of the distillation curve revealed both a lower IBP number and a much higher end point then diesel. However, the presence of low molecular weight (smaller carbon chains) components, as represented by ethanol and gamma-valerolactone, and very large chain lengths present in kerosene made it difficult to formulate a single additive polymer to function effectively throughout the carbon chain distribution. Thus a combination of additives presented in Examples 2 and 3 were used.

The additive prepared in Example 2 was effective in homogenizing the higher chain lengths of the blend and the additive prepared in Example 3 was effective in homogenizing the ethanol and the gamma-valerolactone present in the fuel. Depending upon the proportions or distribution of the carbon chains present in the fuel, the ratio of additives prepared under Examples 2 and 3 was determined for the application.

The final homogenized fuel was tested for stability and phase separation based on a 5% water tolerance limit. The treated fuel was also tested for stability by studying the effect of temperature on solubilized water between −21° C. and +40° C. using gas chromatography and/or HPLC technique. If two different phases were observed at any time during this treatment, separate samples from each layer were extracted to determine a partition coefficient.

The foregoing detailed description is provided for clearness of understanding only, and no unnecessary limitations should be understood therefrom, as modifications within the scope of the invention will be apparent to persons of ordinary skill in the art.

What is claimed is:

1. A polymeric fuel additive made by a method comprising the steps of:

(a) isothermally mixing substantially equimolar amounts of an ethoxylated alcohol and an amide, said ethoxylated alcohol comprising at least about 75 weight percent of at least one linear straight-chain alcohol having a hydrocarbon chain length of about nine to about fifteen carbon atoms, and said amide being a substantially equimolar reaction product of an alcohol amine and an alkyl ester of a fatty acid, wherein each of said alcohol and said amide is dissolved in a solvent; and, (b) isothermally mixing the product of step (a) with an ethoxylated fatty acid or derivative having a hydrocarbon chain length of about nine to about fifteen carbon atoms to form said polymeric fuel additive, wherein said fatty acid or derivative is dissolved in a solvent.

2. The polymeric fuel additive of claim 1, wherein said ethoxylated fatty acid or derivative is a reaction product of an unmodified fatty acid or derivative having a hydrocarbon chain length of about nine to about fifteen carbon atoms and an ethoxylating agent.

3. A method of making a polymeric fuel additive, said method comprising the steps of:

(a) isothermally mixing substantially equimolar amounts of an ethoxylated alcohol and an amide, said ethoxylated alcohol comprising at least about 75 weight percent of at least one linear straight-chain alcohol having a hydrocarbon chain length of about nine to about fifteen carbon atoms, and said amide being the substantially equimolar reaction product of an alcohol amine and an alkyl ester of a fatty acid, wherein each of said alcohol and said amide is dissolved in a solvent; and, (b) isothermally mixing the product of step (a) with an ethoxylated fatty acid or derivative having a hydrocarbon chain length of about nine to about fifteen carbon atoms to form said polymeric fuel additive, wherein said fatty acid or derivative is dissolved in a solvent.

4. The method of claim 3, wherein said ethoxylated fatty acid or derivative is a reaction product of an unmodified fatty acid or derivative having a hydrocarbon chain length of about nine to about fifteen carbon atoms and an ethoxylating agent.

5. A polymeric fuel additive comprising the reaction product of:

(a) a mixture of an ethoxylated alcohol and an amide, said ethoxylated alcohol comprising at least about 75 weight percent of at least one linear straight-chain alcohol having a hydrocarbon chain length of about nine to about fifteen carbon atoms, and said amide being a substantially equimolar reaction product of an alcohol amine and an alkyl ester of a fatty acid; and, (b) an ethoxylated fatty acid or derivative having a hydrocarbon chain length of about nine to about fifteen carbon atoms.

6. The polymeric fuel additive of claim 5, wherein in said mixture (a) each of said alcohol, said amide, and said fatty acid is dissolved in a solvent.

7. The polymeric fuel additive of claim 5, wherein said mixture (a) contains equimolar amounts of said ethoxylated alcohol and said amide.

8. The polymeric fuel additive of claim 5, wherein said ethoxylated fatty acid or derivative is a reaction product of an unmodified fatty acid or derivative having a hydrocarbon chain length of about nine to about fifteen carbon atoms and an ethoxylating agent.

9. The polymeric fuel additive of claim 8, wherein said ethoxylated fatty acid or derivative is a reaction product of an unmodified fatty acid or derivative having a hydrocarbon chain length of about nine to about fifteen carbon atoms and ethylene oxide.

10. The polymeric fuel additive of claim 9, wherein said ethoxylated fatty acid or derivative is formed by reacting the unmodified fatty acid or derivative with at least about seven moles of the ethylene oxide per mole of unmodified fatty acid.

11. The polymeric fuel additive of claim 9, wherein said unmodified fatty acid derivative is an alkyl ester of a fatty acid.

12. The polymeric fuel additive of claim 5, wherein said alkyl ester of a fatty acid is methyl ester of a fatty acid, said fatty acid having a hydrocarbon chain length of at least about nine carbon atoms.

13. The polymeric fuel additive of claim 5, wherein said ethoxylated alcohol and said amide are isothermally mixed at a temperature of about 55° C. to about 58° C.

14. The polymeric fuel additive of claim 5, wherein said amide is formed by reacting said alkyl ester of a fatty acid and said alcohol amine at a temperature of about 100° C. to about 110° C.

15. The polymeric fuel additive of claim 5, wherein said alcohol amine comprises one or more compounds selected from the group consisting of ethanolamine, diethanolamine, and triethanolamine.

16. The polymeric fuel additive of claim 5, wherein said mixture (a) and said ethoxylated fatty acid or derivative (b) are isothermally mixed at a temperature of about 55° C. to about 58° C. to form said reaction product.

17. The polymeric fuel additive of claim 5, wherein said straight-chain alcohols have hydrocarbon chain lengths of about eleven carbon atoms.

18. The polymeric fuel additive of claim 5, wherein said ethoxylated alcohol has an average molecular weight of less than about 200.

19. The polymeric fuel additive of claim 5, wherein said ethoxylated alcohol has an average molecular weight of less than about 160.

20. A fuel composition comprising:

(a) a hydrocarbon-based fuel having hydrocarbon chain lengths of about four to about thirty carbon atoms; and (b) a polymeric fuel additive comprising the reaction product of:

(i) a mixture of equimolar amounts of an ethoxylated alcohol and an amide, said ethoxylated alcohol comprising at least about 75 weight percent of at least one linear straight-chain alcohol having a hydrocarbon chain length of about nine to about fifteen carbon atoms, and said amide being a substantially equimolar reaction product of an alcohol amine and an alkyl ester of a fatty acid; and, (ii) an ethoxylated fatty acid or derivative having a hydrocarbon chain length of about nine to about fifteen carbon atoms.

21. The fuel composition of claim 20, wherein in (b) each of said alcohol, said amide, and said fatty acid or derivative is dissolved in a solvent.

22. The fuel composition of claim 20, wherein said ethoxylated fatty acid or derivative is a reaction product of an unmodified fatty acid or derivative having a hydrocarbon chain length of about nine to about fifteen carbon atoms and an ethoxylating agent.

23. The fuel composition of claim 22, wherein said ethoxylated fatty acid or derivative is a reaction product of an unmodified fatty acid or derivative having a hydrocarbon chain length of about nine to about fifteen carbon atoms and ethylene oxide.

24. The fuel composition of claim 23, wherein said ethoxylated fatty acid or derivative is formed by reacting the unmodified fatty acid or derivative with at least about seven moles of the ethylene oxide per mole of unmodified fatty acid.

25. The fuel composition of claim 23, wherein said unmodified fatty acid derivative is an alkyl ester of a fatty acid.

26. The fuel composition of claim 20, wherein said alkyl ester of a fatty acid is methyl ester of a fatty acid, said fatty acid having a hydrocarbon chain length of at least about nine carbon atoms.

27. The fuel composition of claim 20, wherein said ethoxylated alcohol and said amide are isothermally mixed at a temperature of about 55° C. to about 58° C.

28. The fuel composition of claim 20, wherein said amide is formed by reacting said alkyl ester of a fatty acid and said alcohol amine at a temperature of about 100° C. to about 110° C.

29. The fuel composition of claim 20, wherein said alcohol amine comprises one or more compounds selected from the group consisting of ethanolamine, diethanolamine, and triethanolamine.

30. The fuel composition of claim 20, wherein said mixture (i) and said ethoxylated fatty acid or derivative (ii) are isothennally mixed at a temperature of about 55° C. to about 58° C. to form said reaction product.

31. The fuel composition of claim 20, wherein said straight-chain alcohols have hydrocarbon chain lengths of about eleven carbon atoms.

32. The fuel composition of claim 20, wherein said ethoxylated alcohol has an average molecular weight of less than about 200.

33. The fuel composition of claim 20, wherein said ethoxylated alcohol has an average molecular weight of less than about 160.

34. The fuel composition of claim 20, wherein the fuel (a) and the polymeric fuel additive (b) are present in the fuel composition in a volumetric ratio of (a) to (b) of 1000 to 1.

* * * * *